United States Patent [19]

Bush

[11] 3,945,566

[45] Mar. 23, 1976

[54] SPRING RAIL PLATE FASTENERS FOR DIRECT RAILROAD TRACK FIXATION

[75] Inventor: Charles J. Bush, Wood Ridge, N.J.

[73] Assignee: New York City Transit Authority, Brooklyn, N.Y.

[22] Filed: Sept. 23, 1974

[21] Appl. No.: 508,149

[52] U.S. Cl. ..... 238/349; 238/19; 238/20; 238/21; 238/283

[51] Int. Cl.[2] ..... E01B 9/30

[58] Field of Search ..... 238/17, 19, 20, 21, 187, 238/205, 206, 264, 283, 338, 343, 349

[56] References Cited

UNITED STATES PATENTS

| | | | |
|---|---|---|---|
| 782,443 | 2/1905 | Ford | 238/17 |
| 1,177,088 | 3/1916 | Babijczuk | 238/205 |
| 1,463,943 | 8/1923 | Fallon | 238/20 |
| 3,295,760 | 1/1967 | Moses | 238/283 |
| 3,517,883 | 6/1970 | Holstein | 238/349 X |
| 3,819,114 | 6/1974 | Bush | 238/21 X |

*Primary Examiner*—Albert J. Makay
*Assistant Examiner*—Randolph A. Reese
*Attorney, Agent, or Firm*—Anthony J. Casella

[57] ABSTRACT

A railroad track fastener assembly consisting of a spring plate and a resilient seat for a railroad rail comprising a pad of resilient material positioned between the rail base and the base of a spring plate. The spring plate may be bolted to any type of cross tie or foundation of concrete, steel, or wood. The pad of resilient material is formed with a plurality of spaced vertical holes and is either bonded to the base of the spring plate and is freely positioned within the spring plate. The pad is retained within the spring plate by spring shoulder clips that are secured to the spring plate shoulders resiliently checking the upward motion of the rail under a heavy load. Guard rails and braces are provided for maintaining the wheels of rolling stock on the rails while rounding curves. Accordingly, the rail seat assembly of the subject invention is in effect a railroad track direct fixation spring plate fastener which is operative to achieve noise and vibration attenuation; resistance to rail wave action stress and tie twisting, and is also adaptable for variation in the gage of the rails.

11 Claims, 10 Drawing Figures

SPRING RAIL PLATE FASTENERS FOR DIRECT RAILROAD TRACK FIXATION

BACKGROUND OF THE INVENTION

It is the standard practice to support railroad rails by securing them on wooden cross ties with steel tie plates being placed between the cross ties and the rails. The wooden ties, anchored in a bed of crushed stone, provide the proper resiliency for the rails when a heavy load passes over them. Wood ties, however, have short life span, do not abate noise and must be replaced often. Efforts have been made to use concrete and steel cross ties or concrete roadbeds but these attempts have not been too successful because there is no "give" to a concrete or steel block resulting in a hard ride for the rolling stock and a frequent failure of the cross ties and fasteners after a few months under operation.

In known prior art direct fasteners, the fasteners merely cushion the downward forces developed by the rails to a smaller or a larger degree depending on the resiliency and the configuration of the resilient pads placed directly under the base of the rail. All of such known direct fasteners are rigid in relation to the upward motion of the rails that, of course, flex under moving loads of rolling stock. Upward flexing becomes extremely critical under the impact of defective wheels with flats or out-of-rounds. It is believed that failures or damages sustained by presently know direct fasteners used to anchor rails, concrete beds or concrete ties are caused primarily by those extreme conditions produced by defective rolling stock. It is generally recognized that presently available fasteners are too rigid to meet the requirements of modern railroad transportation systems.

In order to obviate the shortcomings of the prior art systems, the present invention is broadly concerned with improved railroad trackage, and is particularly directed towards relieving the anchor pull-out stresses in rigid track bed slabs, as well as the pull-out and twisting stresses developed in the cross ties as induced by the wave action of the rail in moving loads. The subject invention meets the criteria of a fastener that is rigid enough to restrain logitudinal rail movement, while at the same time being resilient enough to accommodate the upward movement of the rail during its wave action when subjected to a moving load. The development of twisting of cross ties induced by out-of-phase wave action of the opposed rails, and by the differential depression and lifting action in the track rails, is prevented by the subject invention by means of the spring plate fastener thereof. With respect to the latter, the subject device utilizes a specially formed steel plate having folded over shoulders which, together with an air entrapped elastomeric molding, forms a rail base and a guideway for the rail. The elastomeric element is of special design and shape, and includes air entrapped pockets which inhibit noise and vibration developed in the trackway.

In the design of the spring plate fastener of the subject invention, the steel spring plate is in combination with an elastomeric rail base supporting element and track bed slabs, beams or cross ties. The subject assembly may be employed in all environments of track installation and geometry, and in all applications dealing with different track alignments. The subject invention greatly improves the track operational properties, and may be employed in conjunction with concrete or steel track beds, as well as in conjunction with wood ties in stone or concrete ballast. The subject device may be employed in new construction, or may be substituted during reconstruction of existing track. Utilizing the subject invention, all of the forces acting on the rail are accommodated; upward forces are dissipated by means of the folded-over shoulders of the steel spring plate; traction or longitudinal forces, as well as lateral or centrifugal forces are transferred into the base of the steel spring plate, thus engaging simultaneously all anchor bolts in shear thereby preventing the latter from bending, breaking or pulling out; and vibrational forces are dissipated by means of the elastomeric rail base supporting element dampening noise and tremors, as more fully described hereinafter.

Utilizing the subject fastening system, easy maintenance as well as improved life of the rail system is achieved. This is especially so when the subject system is employed in subway systems which include sharp curves and are subjected to heavy usage. The subject device is also adaptable for installation of guard or restraining rails parallel to the running or main rail.

Accordingly, it is an object of the subject invention to provide a simple, economical, and highly efficient rail fastener system that can be readily adaptable for a wide variety of usage in either existing or new rail construction. At the same time it is an object of this invention to provide a system that greatly reduces noise polution and vibration transmission to the surroundings.

SUMMARY

The invention comprises a resilient rail seat for a railroad rail and includes a spring plate secured to a foundation by anchor bolts. The ends of the spring plate are turned over to form shoulders for checking the upward wave action of the rail and for retaining the rail against side slip. An elastomeric pad is positioned between a base portion of the spring plate and the bottom surface of the rail, this portion of the pad being formed with a plurality of spaced compartments for providing the desired shape factor and elastic behavior of the pad. The pad is also formed with two side extensions for folding around the two base flanges of the rail. Two shoulder extension clips are fastened to the shoulders of the spring plate for retaining the two pad extensions in contact with the upper surfaces of the rail flanges.

The invention also includes a rail brace secured to a shoulder of the spring base for bracing the rail against side motion on curves. Additional check for centrifugal forces is provided by a guard rail, supported on the elastomeric pad vertically, or secured horizontally on a steel bracket.

The unique railroad track fastener assembly of the subject invention achieves direct fixation of the rail to the supporting base, and inherently includes means for noise and vibration reduction, as well as inherently including means for relieving rail wave action and cross tie twisting stresses. The fastener assembly base is rigidly secured to the track bed, and is adaptable to accommodate track gauge adjustment mechanisms and unbalanced super elevation restraining hardware, as well as guard rail supports. One of the unique features of the subject fastener assembly is that the spring steel plate is shaped to act as a rail alignment guideway; a rail-to-base fastener; and a rail hold-down spring to cushion upward rail motion under the wave action, and to relieve destructive stresses. The specially formed elastomeric rail supporting seat that is either separate from or bonded to the spring plate at its base, cushions downward forces, whereby the resilient elastomeric element combines the cushioning effect of the elastomeric materials and the trapped air within the resilient element.

Additional details of the invention will be disclosed in the following description, taken in connection with the accompanying drawings.

DESCRIPTION OF THE PREFERRED EMBODIMENTS

Figure 1:
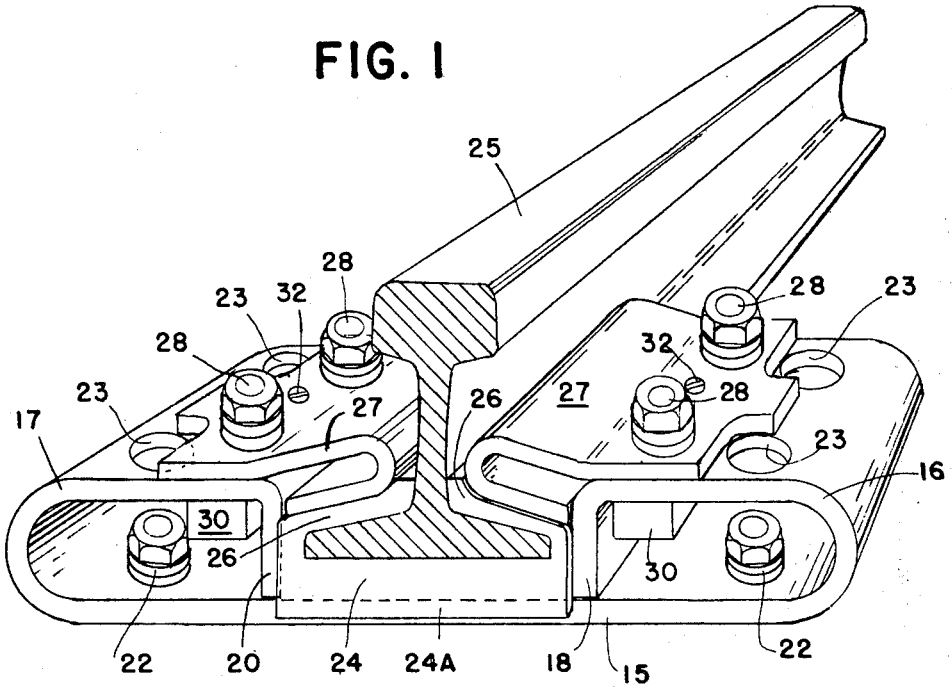
FIG. 1 is a perspective view of the rail seat assembly.
Figure 2:
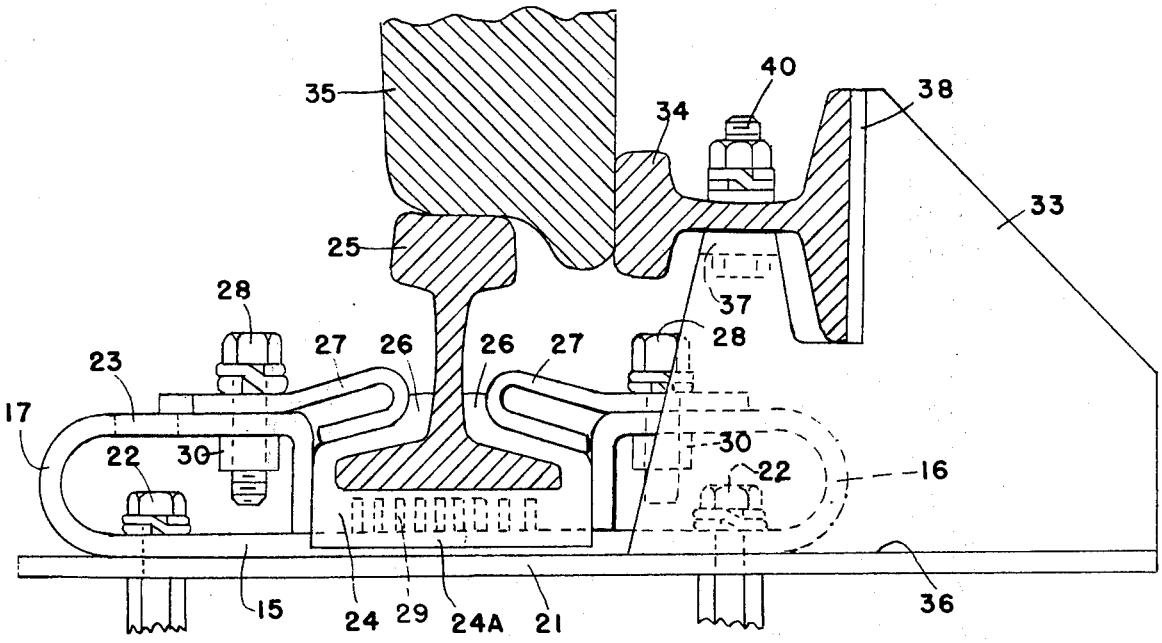
FIG. 2 is an end view, with some parts in section, of the rail seat assembly in conjunction with a horizontal guard rail supported by a bracket and a bracket bridge.
Figure 3:
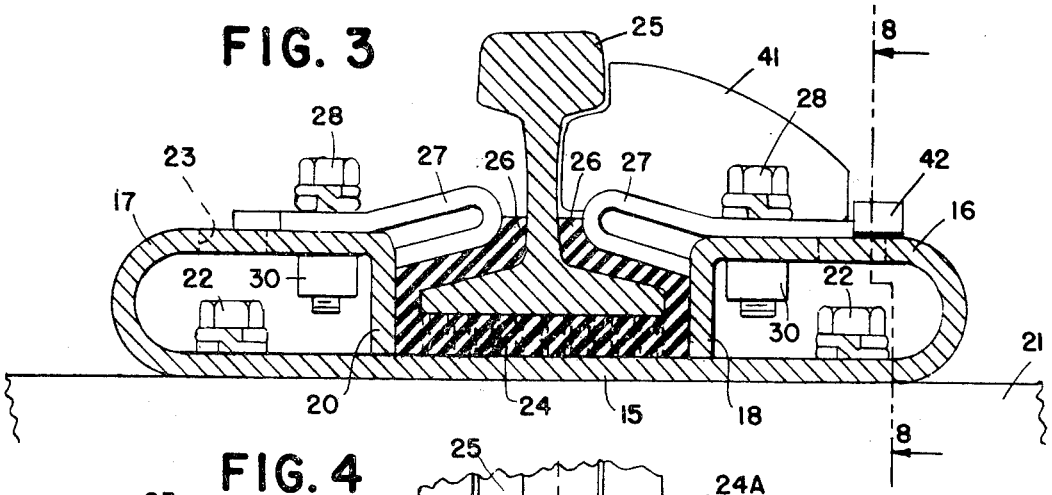
FIG. 3 is a cross sectional view of the rail seat assembly for super elevated rail taken along line 3—3 of FIG. 4.
Figure 4:
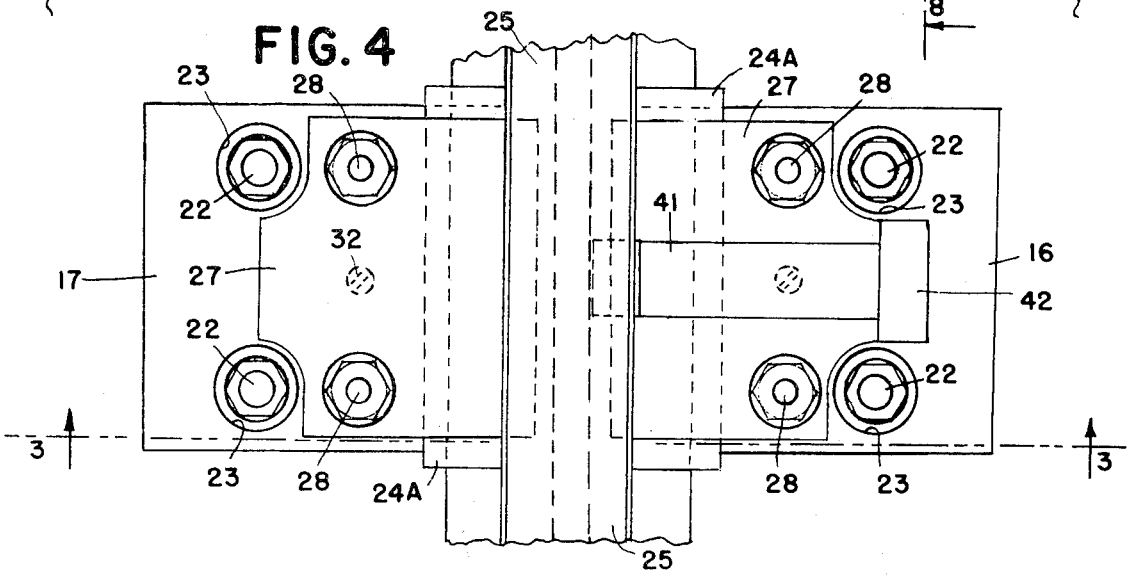
FIG. 4 is a plan view of the rail seat assembly for a super elevated rail brace.

Referring now to FIGS. 1, 3, and 4, the resilient rail seat comprises a spring plate 15 formed with turned over end portions 16, 17, and vertical shoulder portions 18 and 20. The spring plate 15 is anchored to a base 21 (shown in FIGS. 2, 3, 6, and 8) which may be a concrete block concrete roadbed, concrete, wood or a steel tie. Anchor bolts 22 or any other convenient form of fastening units may be used to secure the spring plate 15 to a roadbed. In view shown in FIG. 1 bolts 22 are used, tightened by a wrench inserted through holes 23.

An elastomeric pad 24 is positioned on the base portion of the spring base 15 with overhanging flanges 26. The railroad rail 25 is placed on top of the pad 24 and then side extensions 26 are folded around the bottom flanges of the rail and held in place by shoulder extension clips 27. When the clips 27 are firmly secured in place by bolts 28, the extensions 26 are firmly clamped in the positions shown and the end portions 17 provide proper hold-down force and cantilevered spring beams.

Figure 6:
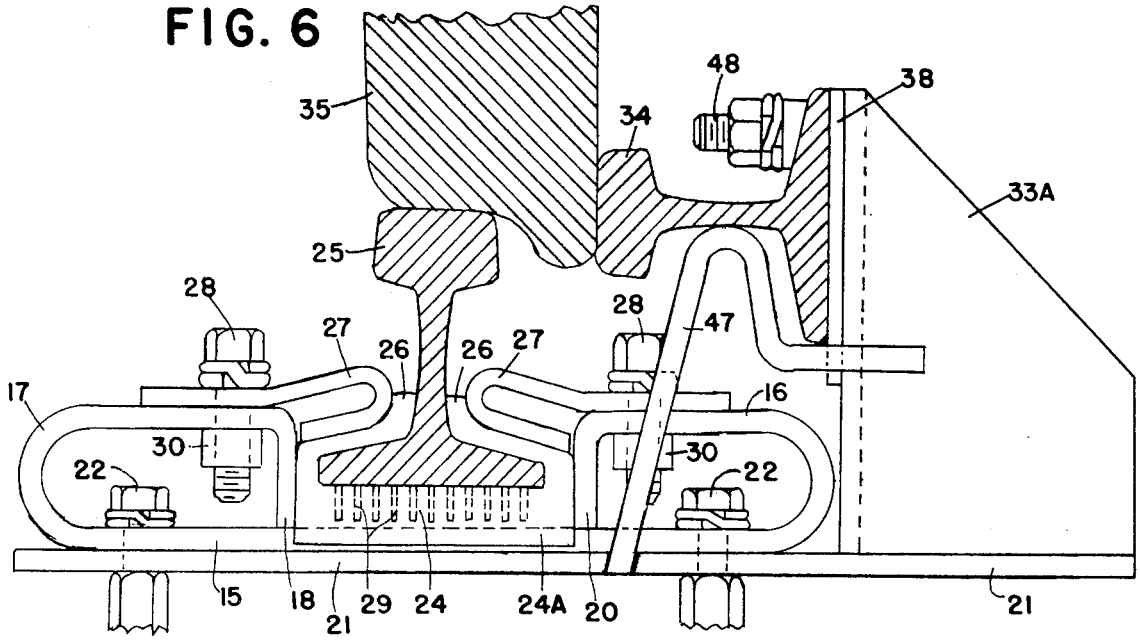
FIG. 6 is an end view, with some parts in section, of the rail seat assembly in combination with a horizontal guard rail supported by the bar chairs and and secured to the guard rail bracket.
Figure 9:
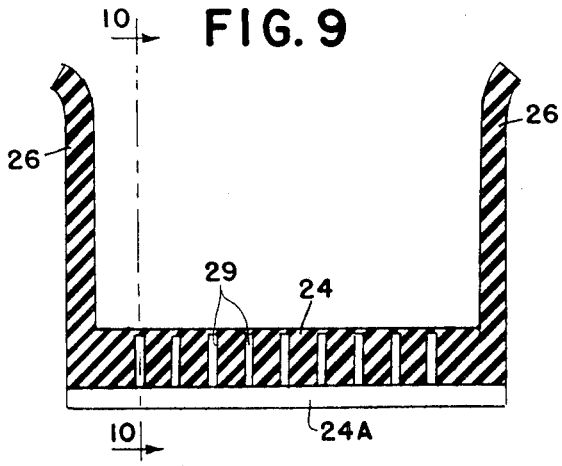
FIG. 9 is a cross sectional view of the elastomeric pad showing the air holes and the side extensions. This section is taken along line 9—9 of FIG. 10.
Figure 10:
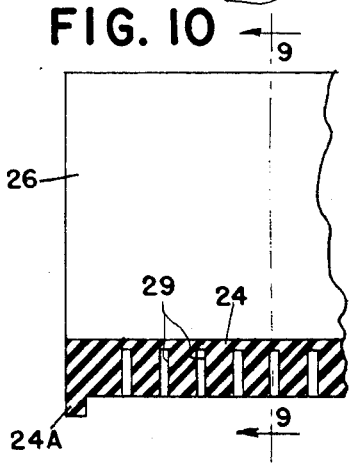
FIG. 10 is a cross sectional view of the elastomeric pad taken along line 10—10 of FIG. 9.

The main portion of the pad 24 is below the bottom surface of rail 25 and, in order to provide the desired resiliency, a plurality of holes 29 are formed in this portion. The holes do not pass entirely through the pad section but limit near one surface. FIGS. 2, 9, and 10 show the holes 29 open at the bottom, FIG. 6 shows them open at the top. Either structure is efficient as long as the open ends of the holes 29 are assembled adjoining a flat surface. The preferred method of assembly is by bonding, so that the air in the compartments can never escape but always acts as an air spring permitting the walls of the elastomeric material to compress and expand as a heavy load are intermittently applied to the rails. The pad 24 may, of course, be made of natural rubber and many other materials but the preferred materials are neoprene and butyl rubber, this material, having a long life and not subject to hardening nor to disintegration in the presence of oils and petrochemical derivatives.

It is important to provide upward vertical resiliency as well as the spring action under the rail. Upward flexing becomes critical under the impact of defective wheels with flats or out-of-round shapes. During the time an impact of defective wheel acts in the vicinity of the rail seat the rail flexes and urges the rail to move upwardly. If such a movement is restrained or blocked, damage may result. Spring clips 27 provide the required upward resiliency when such violent vertical forces are encountered. Spring clips 27 are mounted on the turned over portions 16 and 17 and are secured by bolts 28, threaded into a support rod 30 which are secured to the end portions 16 and 17 before assembly by a central small machine screw 32 or tackwelds and completes the cantilevered portion of the spring plate.

The spring steel fastener plate 15 preferably consists of a single continuous strip, with the shoulders 18 and 20 thereof, together with the shoulder extension brackets or clips 27 providing the guideway to hold the rail base within the fastener assembly. The amount of the grip depends on the elasticity and strength of the folded-over plate 15 at the side bends or turned-over end portions 16, 17. As mentioned above, the spring plate 15 is anchored at its base with four or two anchor bolts 22 to the trackway base, and by this arrangement, all of the anchor bolts 22 act together to resist stresses in all directions. The strength of the spring plate 15 and its grip with which it holds the rail base depends on the thickness of the plate, forming methods, type of steel, heat treatment, tempering, annealing, etc. It is suggested that no less than a ⅜ inch plate of carbon steel be used employing cold forming followed by annealing.

With respect to the elastomeric rail seat base 24, it is suggested that the pad be approximately ¾ inch thick and canted at its base with a ⅜ inch thick upward side long enough to fold over the rail flange and extend on its web for approximately ½ inch under the shoulder extension brackets 27. The sides of the pad are preferably formed vertically, as at 26 in FIG. 9, for easier rail installation and rail removal. The pad may be removable or permanently bonded to the base plate and, as mentioned above, removal of the rails is simply accomplished by removing the shoulder extension brackets 27 only. Thus, the fastener assembly remains in anchored position during the rail removal operation.

With respect to the elastomeric pad, it is noted that the air pockets provide the desired cushioning properties in combination with the inherent cushioning properties achieved by the resiliency of the pad.

The rail seat assembly shown in FIG. 2 is the same as that shown in FIG. 1 except that a guard rail supporting bracket 33 is added to the assembly for holding a horizontal guard rail 34 in positions on curved tracks. Horizontal guard rails are used on lower rails on curves to retain the wheels in their normal positions. When the rolling stock moves too fast on a curve, the wheels tend to move off the rails. FIG. 2 shows a wheel 35 on rail 25 held by guard rail 34. It is obvious that the guard rail 34 be securely anchored to the base structure. Bracket 33 is formed with a long base 36 which is welded to the bracket 33 and the bridge 37 and is free of the spring plate 15. The bracket is formed of two similar plates which straddle the spring plate 15 and are connected to each other by a bridge bar 37. Plates 38 are inserted for horizontal adjustments of the guard rail 34. The bridge bar 37 supports the web of guard rail 34 and is anchored thereto by a bolt 40. Plate 38 supports the guard rail 34 against side motion.

Figure 8:
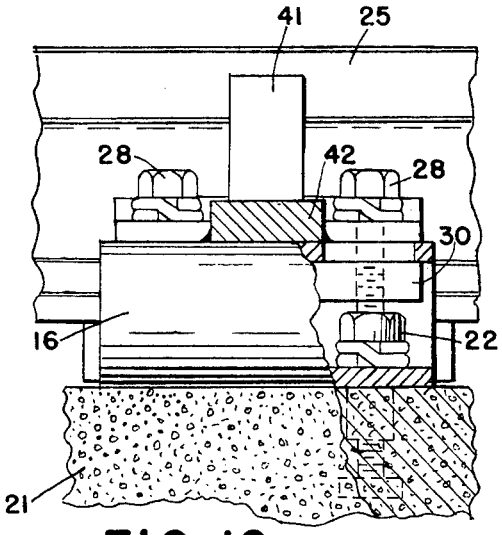
FIG. 8 is a side view, with some parts in section, of the super elevated rail seat assembly shown in FIG. 3 and is taken generally along line 8—8 of that figure.

The rail seat shown in FIGS. 3 and 8 is the same as that shown in FIG. 1 except that a brace 41 is added to a clip 27 and a brace bar 42 is added to the spring plate 15 to check the rail 25 against side motion. The rail brace 41 is welded to the shoulder extension clip 27 and the brace bar 42 welded to the spring plate shoulder 16. Side pressure on rail 25 is first resisted by the pad 24; further side motion moves the rail 25 into contact with the rail brace 41 and resilient counter action is provided by spring plate shoulder 16 and shoulder clip 27.

Figure 5:
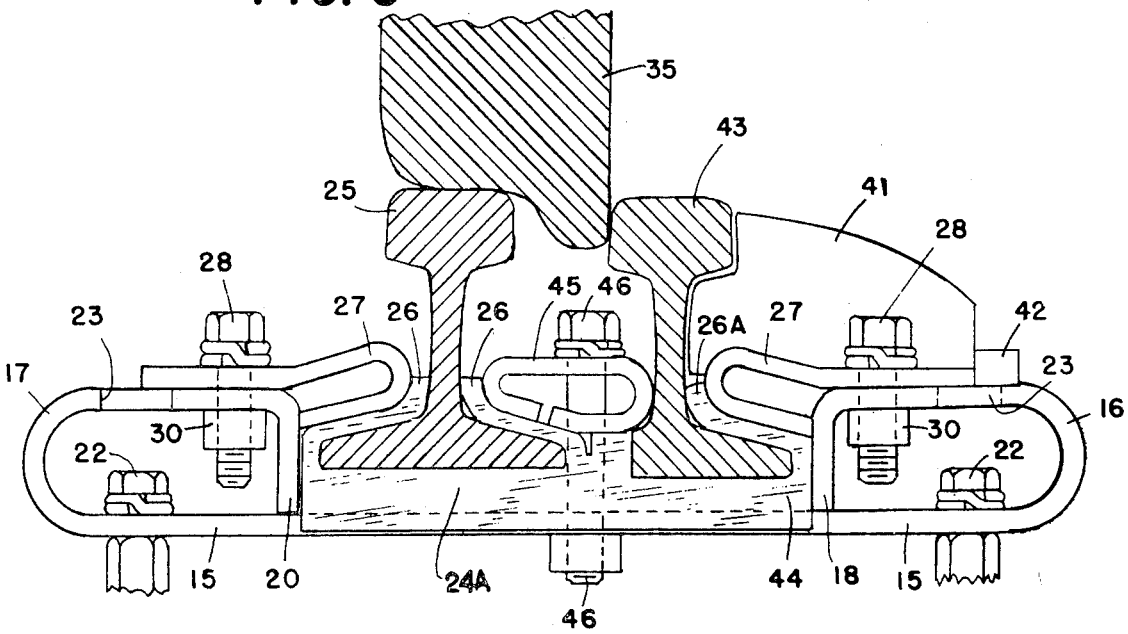
FIG. 5 is an end view, with some parts in section, of the rail seat assembly in combination with a vertical guard rail.

The rail arrangement shown in FIG. 5 adds an additional vertical guard rail 43 to reduce the slide slip of wheel 35. In this array the guard rail 43 is embedded in an extension 44 of the elastomeric pad 24 and its bottom flange is held in place by extension 26A and shoulder clip 27. An elevated rail brace 41 and brace bar 42 also added to resiliently maintain the guard rail 43 against side movement. A center clip 45, made of steel, holds the pad extension 26 in its proper position and also holds the guard rail 43 at a predetermined position from rail 25. The clip 45 is held in place by two bolts 46 which pass through the pad 24 and the base portion of the spring plate 15. The elastomeric pad 24–44 is formed with a plurality of vertical holes 29 (not shown in FIG. 5) in the portion under the running rail 25 only as indicated in FIGS. 2, 6, 9, and 10.

Figure 7:
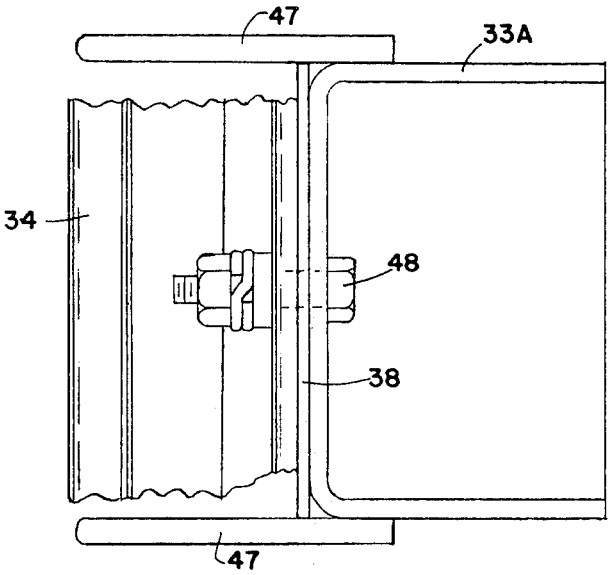
FIG. 7 is a top view of the guard rail bracket support shown in FIG. 6.

The horizontal guard rail device shown in FIGS. 6 and 7 is the same as the device shown in FIG. 2 except that the guard rail 34 is supported by a pair of bent rods 47 and secured to the guard rail bracket 33A by a bolt 48. The rail bracket 33A performs the same function as the rail bracket 33, shown in FIG. 2, but is formed of a single piece of steel, bent into a U-shape, as shown in FIG. 7. Rods 47 are welded to the sides of the bracket 33A and base plate 21.

FIGS. 9 and 10 show the elastomeric pad 24 as it is taken from the mold having a base 24 and two vertical extensions 26 with slightly turned out ends. The holes 29 are shown open at the bottom, the preferred form, but they can be made so as to be open at the top. The overhanging flanges 26 are formed on both ends of the pad so as to provide a definite placement location on the base portion 15 of the spring plate. When the pad 24 is assembled, extensions 26 are bent over by the application of shoulder clips 27.

In summary, the rail seating means of the subject invention provides a smoother ride for passengers and freight and eliminates most of the noise caused by action of the wheels on the rails, while extending the life of the rail and the supporting cross tie elements. In the subject fastening means, the spring plate is designed to achieve two important objectives as it fastens the steel railroad rail to a rigid concrete bed or a massive concrete tie: (1) it provides flexibility in the upward direction under the extreme forces of the deflecting railroad rail. The spring plate is capable of action as a resilient spring along its curved sides, and it is thus capable to "give" rather than to fail as do presently available fasteners under extreme stresses. Thus, the spring plate greatly increases the safety and operational characteristics of the rail system; and (2) the cushioning pad incorporated in the design of the subject assembly improves the use of a resilient pad placed directly under the base of a rail in that it utilizes trapped air as a cushioning effect. Sudden shock will instantly trap the air in the pockets of the elastomeric pad, thereby aiding in the ride and operational characteristics of the rail system. In addition to the above, the subject fastener means greatly aids in noise and vibration abatement programs, and it is adaptable for use with welded rail installations, thereby requiring no anchors. The subject system may be inexpensively produced, and rapidly and efficiently installed.

The rail seat of the subject invention may be employed in conjunction with a railroad load carrying rail that may comprise a curved rail, rail guard, switch, rail switch point, turn-out or a rail cross-over.

The embodiments of the invention in which an exclusive property or privilege is claimed are defined as follows:

1. A resilient rail seat for a railroad load carrying rail comprising: a spring plate secured to a foundation by anchor bolts and including turned over cantilevered end portions having vertical shoulder portions for retaining the rail against side slip; an elastomeric pad positioned between a base portion of the spring plate and the bottom of the rail, the pad formed with a plurality of spaced vertical air compartments for increasing the flexibility of the pad, each said air compartment being open at one side of the pad, the pad also formed with two side extensions for folding around the two base flanges of the rail; and two shoulder extension clips, secured to the cantilevered end portions of the spring plate for retaining the two extensions of the pad in contact with the rail flanges.

2. A rail seat according to claim 1 wherein said air compartments in the pad are open at the lower pad surface and the pad is bonded to the upper surface of the spring plate to form closed air spring cells.

3. A rail seat according to claim 1 wherein said air compartments in the pad are open at the top pad surface for a plunger effect under a sudden application of a load on the rail.

4. A rail seat according to claim 1 wherein super elevated rail brace is secured to one of the shoulder extension clips and having an abutting edge positioned adjacent to the rail for bracing the rail against side movement.

5. A rail seat according to claim 1 wherein a second railroad rail is mounted parallel to the load carrying rail and is seated in an extension of the elastomeric pad material which holds the load carrying rail, said second rail held in position by a spring clip on one side and by a shoulder extension clip on the other side.

6. A rail seat according to claim 5 wherein said elastomeric pad is made to support the parallel guard rail.

7. A rail seat according to claim 1 wherein a second railroad rail is mounted horizontally adjacent to the load carrying rail for bracing contact with a wheel moving on the load carrying rail, said second rail carried by chairs of bent rods secured to a supporting bracket in combination with the subject spring plate.

8. A rail seat according to claim 7 wherein said supporting bracket is made from a single piece of steel and formed with a U-shape.

9. A rail seat according to claim 1 wherein a second railroad rail is mounted horizontally adjacent to the load carrying rail for bracing contact with a wheel moving on the load carrying rail, said second rail carried by a bridge secured to a supporting bracket and secured to the bridge by a bolt in combination with said spring plate.

10. A rail seat as in claim 1 wherein said railroad load carrying rail may comprise a curved rail, rail guard, switch, rail switch point, turn-out or a rail cross-over.

11. A resilient rail seat for a railroad load carrying rail comprising: a spring plate secured to a foundation by anchor bolts and including turned over cantilevered end portions having vertical shoulder portions for retaining the rail against side slip; an elastomeric pad positioned between a base portion of the spring plate and the bottom of the rail, the pad formed with a plurality of spaced vertical air compartments for increasing the flexibility of the pad, the pad also formed with two side extensions for folding around the two base flanges of the rail; and two shoulder extension clips, secured to the cantilevered end portions of the spring plate for retaining the two extensions of the pad in contact with the rail flanges, and wherein a second railroad rail is mounted parallel to the load carrying rail and is supported in an extension of the elastomeric pad material which supports the load carrying rail, said second rail held in position by a spring clip on one side and by a shoulder extension clip on the other side; said elastomeric pad being made to support the parallel guard rail, and said elastomeric pad being molded with a plurality of vertically aligned compartments under the running rail open at one side of the pad with three integrally formed extensions disposed at right angles to the upper surface of the pad.

* * * * *